US008480485B2

(12) United States Patent
Englman et al.

(10) Patent No.: US 8,480,485 B2
(45) **Date of Patent: *Jul. 9, 2013**

(54) WAGERING GAME WITH MULTI-LEVEL PROGRESSIVE GAME

(75) Inventors: Allon G. Englman, Chicago, IL (US); Benjamin T. Gomez, Chicago, IL (US); Michael W. Mastropietro, Chicago, IL (US); Bradley A. Rose, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/476,530

(22) Filed: May 21, 2012

(65) Prior Publication Data

US 2012/0289326 A1 Nov. 15, 2012

Related U.S. Application Data

(63) Continuation of application No. 12/297,426, filed as application No. PCT/US2007/009195 on Apr. 16, 2007, now Pat. No. 8,202,160.

(60) Provisional application No. 60/793,124, filed on Apr. 18, 2006.

(51) Int. Cl.
*A63F 9/24* (2006.01)

(52) U.S. Cl.
USPC ..... 463/27; 463/28

(58) Field of Classification Search
USPC ..... 463/27, 28
See application file for complete search history.

(56) References Cited

U.S. PATENT DOCUMENTS

| | | | | |
|---|---|---|---|---|
| 4,837,728 | A | 6/1989 | Barrie et al. | 364/412 |
| 4,861,041 | A | 8/1989 | Jones et al. | 273/292 |
| 5,116,055 | A | 5/1992 | Tracy | 273/138 A |
| 5,249,800 | A | 10/1993 | Hilgendorf et al. | 273/138 A |
| 5,280,909 | A | 1/1994 | Tracy | 273/138 A |
| 5,344,144 | A | 9/1994 | Canon | 273/138 A |
| 5,417,430 | A | 5/1995 | Breeding | 273/292 |
| 5,564,700 | A | 10/1996 | Celona | 463/27 |
| 5,611,730 | A | 3/1997 | Weiss | 463/20 |

(Continued)

FOREIGN PATENT DOCUMENTS

| | | |
|---|---|---|
| GB | 2313792 A | 12/1997 |
| WO | WO 99/03078 | 1/1999 |

(Continued)

OTHER PUBLICATIONS

Strictly Slots Magazine, "*Jackpot Deluxe*"; p. 54; May 2007 (1 page).

(Continued)

*Primary Examiner* — Pierre E Elisca
(74) *Attorney, Agent, or Firm* — Nixon Peabody LLP

(57) ABSTRACT

A method for playing a wagering game allows an opportunity to achieve a progressive award. A wager input is received from a player for playing the wagering game. A triggered progressive game includes player-selectable elements, each of the player-selectable elements being capable of association with a progressive-winning outcome. An outcome is assigned to each of the player-selectable elements, wherein a probability that the outcome is a progressive-winning outcome depends upon an amount of the wager input. The player-selectable elements are displayed.

20 Claims, 7 Drawing Sheets

U.S. PATENT DOCUMENTS

| | | | | |
|---|---|---|---|---|
| 5,645,486 | A | 7/1997 | Nagao et al. | 463/27 |
| 5,647,592 | A | 7/1997 | Gerow | 273/139 |
| 5,655,961 | A | 8/1997 | Acres et al. | 463/27 |
| 5,766,076 | A | 6/1998 | Pease et al. | 463/27 |
| 5,851,147 | A | 12/1998 | Stupak et al. | 463/13 |
| 5,876,284 | A | 3/1999 | Acres et al. | 463/25 |
| 5,885,158 | A | 3/1999 | Torango et al. | 463/27 |
| 5,941,773 | A | 8/1999 | Harlick | 463/26 |
| 5,944,606 | A | 8/1999 | Gerow | 463/27 |
| 5,951,011 | A | 9/1999 | Potter et al. | 273/292 |
| 6,032,955 | A | 3/2000 | Luciano et al. | 273/138.1 |
| 6,089,980 | A | 7/2000 | Gauselmann | 463/27 |
| 6,102,799 | A | 8/2000 | Stupak | 463/27 |
| 6,110,043 | A | 8/2000 | Olsen | 463/27 |
| 6,203,010 | B1 | 3/2001 | Jorasch et al. | 273/138.1 |
| 6,210,275 | B1 | 4/2001 | Olsen | 463/16 |
| 6,217,448 | B1 | 4/2001 | Olsen | 463/25 |
| 6,224,482 | B1 | 5/2001 | Bennett | 463/20 |
| 6,224,484 | B1 | 5/2001 | Okuda et al. | 463/27 |
| 6,231,445 | B1 | 5/2001 | Acres | 463/42 |
| 6,241,608 | B1 | 6/2001 | Torango | 463/27 |
| 6,336,862 | B1 | 1/2002 | Byrne | 463/27 |
| 6,358,149 | B1 | 3/2002 | Schneider et al. | 463/27 |
| 6,416,409 | B1 | 7/2002 | Jordan | 463/27 |
| 6,431,983 | B2 | 8/2002 | Acres | 463/25 |
| 6,589,115 | B2 | 7/2003 | Walker et al. | 463/25 |
| 6,592,458 | B1 | 7/2003 | Ho | 463/17 |
| 6,599,188 | B2 | 7/2003 | Hirsch et al. | 463/19 |
| 6,599,193 | B2 | 7/2003 | Baerlocher et al. | 463/27 |
| 6,656,052 | B2 | 12/2003 | Abramopoulos et al. | 463/47 |
| 6,676,513 | B2 | 1/2004 | Gauselmann | 463/20 |
| 6,712,695 | B2 | 3/2004 | Mothwurf et al. | 463/25 |
| 6,776,715 | B2 | 8/2004 | Price | 463/27 |
| 6,887,154 | B1 | 5/2005 | Luciano, Jr. et al. | 463/26 |
| 7,004,466 | B2 | 2/2006 | Gauselmann | 273/139 |
| 7,056,215 | B1 | 6/2006 | Olive | 463/27 |
| 2003/0027625 | A1 | 2/2003 | Rowe | 463/20 |
| 2003/0181231 | A1 | 9/2003 | Vancura et al. | 463/9 |
| 2003/0211884 | A1 | 11/2003 | Gauselmann | 463/26 |
| 2003/0222402 | A1 | 12/2003 | Olive | 273/292 |
| 2003/0228899 | A1 | 12/2003 | Evans | 463/25 |
| 2003/0236116 | A1 | 12/2003 | Marks et al. | 463/16 |
| 2004/0009808 | A1 | 1/2004 | Gauselmann | 463/25 |
| 2004/0023716 | A1 | 2/2004 | Gauselmann | 463/26 |
| 2004/0038741 | A1 | 2/2004 | Gauselmann | 463/26 |
| 2004/0048644 | A1 | 3/2004 | Gerrard et al. | 463/16 |
| 2004/0092304 | A1 | 5/2004 | George et al. | 463/29 |
| 2005/0003880 | A1 | 1/2005 | Englman et al. | 463/16 |
| 2005/0054434 | A1 | 3/2005 | Baerlocher et al. | 463/25 |
| 2005/0055113 | A1 | 3/2005 | Gauselmann | 700/91 |
| 2005/0059467 | A1 | 3/2005 | Saffari et al. | 463/19 |
| 2005/0059472 | A1 | 3/2005 | Joshi et al. | 463/20 |
| 2005/0059481 | A1 | 3/2005 | Joshi et al. | 463/27 |
| 2005/0064930 | A1 | 3/2005 | Jubinville et al. | 463/17 |
| 2005/0096130 | A1 | 5/2005 | Mullins | 463/27 |
| 2005/0137010 | A1 | 6/2005 | Enzminger et al. | 463/25 |
| 2005/0192088 | A1 | 9/2005 | Hartman et al. | 463/27 |
| 2005/0215313 | A1 | 9/2005 | O'Halloran | 463/26 |
| 2006/0003829 | A1 | 1/2006 | Thomas | 463/20 |
| 2006/0019737 | A1 | 1/2006 | Yang | 463/19 |
| 2006/0025195 | A1 | 2/2006 | Pennington et al. | 463/16 |
| 2006/0025210 | A1 | 2/2006 | Johnson | 463/25 |
| 2006/0030403 | A1 | 2/2006 | Lafky et al. | 463/27 |
| 2006/0052159 | A1 | 3/2006 | Cahill et al. | 463/27 |
| 2006/0073887 | A1 | 4/2006 | Nguyen et al. | 463/27 |
| 2006/0073889 | A1 | 4/2006 | Edidin et al. | 463/27 |
| 2006/0116201 | A1 | 6/2006 | Gauselmann | 463/26 |
| 2006/0142079 | A1 | 6/2006 | Ikehara et al. | 463/27 |
| 2006/0142086 | A1 | 6/2006 | Blackburn et al. | 463/42 |
| 2006/0154718 | A1 | 7/2006 | Willyard et al. | 463/25 |
| 2006/0178203 | A1 | 8/2006 | Hughes et al. | 463/20 |
| 2006/0183535 | A1 | 8/2006 | Marks et al. | 463/20 |
| 2006/0183537 | A1 | 8/2006 | Dickerson | 463/27 |
| 2006/0183538 | A1 | 8/2006 | Michaelson et al. | 463/27 |
| 2006/0281527 | A1 | 12/2006 | Dunaevsky et al. | 463/20 |
| 2006/0287077 | A1 | 12/2006 | Grav et al. | 463/27 |
| 2007/0026941 | A1 | 2/2007 | Block et al. | 463/29 |
| 2007/0054733 | A1 | 3/2007 | Baerlocher | 463/27 |
| 2007/0060244 | A1 | 3/2007 | Yaldoo et al. | 463/16 |
| 2007/0060271 | A1 | 3/2007 | Cregan et al. | 463/16 |
| 2007/0060314 | A1 | 3/2007 | Baerlocher et al. | 463/25 |
| 2007/0060319 | A1 | 3/2007 | Block et al. | 463/27 |
| 2007/0060365 | A1 | 3/2007 | Tien et al. | 463/42 |
| 2007/0259711 | A1 | 11/2007 | Thomas | 463/22 |
| 2008/0015005 | A1 | 1/2008 | Yaldoo et al. | 463/16 |
| 2008/0015012 | A1 | 1/2008 | Englman et al. | 463/25 |
| 2008/0076503 | A1* | 3/2008 | Mattice et al. | 463/16 |
| 2008/0108410 | A1 | 5/2008 | Baerlocher | 463/20 |
| 2008/0108425 | A1* | 5/2008 | Oberberger | 463/25 |
| 2008/0113770 | A1 | 5/2008 | Gelber et al. | 463/25 |
| 2009/0042638 | A1* | 2/2009 | Thomas | 463/20 |
| 2010/0124973 | A1* | 5/2010 | DeWaal et al. | 463/20 |
| 2011/0124402 | A1* | 5/2011 | De Waal et al. | 463/25 |
| 2011/0269537 | A1* | 11/2011 | Mattice et al. | 463/25 |
| 2012/0021816 | A1* | 1/2012 | Aoki | 463/20 |

FOREIGN PATENT DOCUMENTS

| | | | |
|---|---|---|---|
| WO | WO 01/33478 | A1 | 5/2001 |
| WO | WO 2005/032675 | A2 | 4/2005 |
| WO | WO 2005/099425 | A2 | 10/2005 |
| WO | WO 2006/014990 | A2 | 2/2006 |
| WO | WO 2006/039349 | A2 | 4/2006 |
| WO | WO 2006/130597 | A2 | 12/2006 |
| WO | WO 2006/130611 | A2 | 12/2006 |
| WO | WO 2007/028108 | A2 | 3/2007 |
| WO | WO 2007/117502 | A2 | 10/2007 |
| WO | WO 2007/123858 | A2 | 11/2007 |
| WO | WO 2008/005366 | A2 | 1/2008 |
| WO | WO 2008/021449 | A2 | 2/2008 |
| WO | WO 2008/039403 | A2 | 4/2008 |
| WO | WO 2008/057356 | A2 | 5/2008 |
| WO | WO 2008/063297 | A2 | 5/2008 |
| WO | WO 2008/063394 | A2 | 5/2008 |

OTHER PUBLICATIONS

Lottery Insider, "*Aristocrat Unveils the Evolution of Hyperlink With Jackpot Deluxe*! (Apr. 12, 2007)", vol. 39 No. 4; Apr. 23, 2007 (1 page).

VegasNews.com, "Aristocrat Unveils Jackpot Deluxe With Hyperlink", Mar. 29, 2007 (3 pages).

International Search Report for PCT Application No. PCT/US2007/009195 dated Jun. 13, 2008 (2 pages).

Written Opinion of the International Searching Authority for PCT Application No. PCT/US2007/009195 dated Jun. 13, 2008 (5 pages).

* cited by examiner

TABLE 1 - WAGER INPUT OF 1 CREDIT (MINIMUM WAGER)

| RANDOM NUMBER | AWARD |
|---|---|
| 1 | PROGRESSIVE COIN + 50 CREDITS |
| 2-100 | 50 CREDITS |
| 101-200 | 100 CREDITS |
| 201-300 | 200 CREDITS |
| 301-400 | 300 CREDITS |
| 401-500 | 5 ADDITIONAL FREE SPINS |

TABLE 2 - WAGER INPUT OF 60 CREDITS

| RANDOM NUMBER | AWARD |
|---|---|
| 1-60 | PROGRESSIVE COIN + 50 CREDITS |
| 61-100 | 50 CREDITS |
| 101-200 | 100 CREDITS |
| 201-300 | 200 CREDITS |
| 301-400 | 300 CREDITS |
| 401-500 | 5 ADDITIONAL FREE SPINS |

TABLE 3 - WAGER INPUT OF 100 CREDITS (MAXIMUM WAGER)

| RANDOM NUMBER | AWARD |
|---|---|
| 1-100 | PROGRESSIVE COIN + 50 CREDITS |
| 101-200 | 100 CREDITS |
| 201-300 | 200 CREDITS |
| 301-400 | 300 CREDITS |
| 401-500 | 5 ADDITIONAL FREE SPINS |

Fig. 7

WAGERING GAME WITH MULTI-LEVEL PROGRESSIVE GAME

CROSS REFERENCE TO RELATED APPLICATIONS

This application is a continuation of U.S. patent application Ser. No. 12/297,426, filed Oct. 16, 2008, now allowed, which is a U.S. national stage of International Application No. PCT/US2007/009195, filed Apr. 16, 2007, which is related to and claims priority to U.S. Provisional Application No. 60/793,124, filed Apr. 18, 2006, each of which is incorporated herein its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines and, more particularly, to a progressive game having a multi-level progressive award.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by increasing the entertainment value and excitement for the player.

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game and progressive award concepts offers tremendous advantages in player appeal and excitement relative to other known games, and because such games are attractive to both players and operators, there is a continuing need to develop gaming machines with new types of bonus games to satisfy the demands of players and operators.

While these player appeal features provide some enhanced excitement relative to other known games, there is a continuing need to develop new features for gaming machines to satisfy the demands of players and operators. For example, there is a need to provide variations and/or enhancements for progressive games to reward a player for a high wager amount. In another example, there is a need to provide multiple progressive levels in which players can achieve a progressive award more than once. The present invention provides a solution to these and other needs.

SUMMARY OF THE INVENTION

According to one aspect of the present invention, a method for playing a wagering game allows an opportunity to achieve a progressive award. A wager input is received from a player for playing the wagering game. A triggered progressive game includes player-selectable elements, each of the player-selectable elements being capable of association with a progressive-winning outcome. An outcome is assigned to each of the player-selectable elements, wherein a probability that the outcome is a progressive-winning outcome depends upon an amount of the wager input. The player-selectable elements are displayed.

According to another aspect of the invention, a gaming system for playing a wagering game allows an opportunity to achieve a progressive award. The system includes a wager input device, a controller, and a display. The wager input device receives a wager input from a player of the wagering game. The controller is coupled to the wager input device and is programmed to trigger a progressive game including player-selectable elements. Each of the player-selectable elements is capable of being associated with a progressive-winning outcome. The controller is further programmed to assign an outcome to each of the player-selectable elements, wherein a probability that the outcome is a progressive-winning outcome depends upon an amount of the wager input. The display displays the player-selectable elements and is coupled to the controller.

According to yet another aspect of the invention, a method for playing a wagering game allows an opportunity to be awarded a progressive fund. The method includes receiving a wager input from a player of the wagering game and triggering a progressive game. The method further includes, during the progressive game, providing the player with an opportunity to be awarded the same progressive fund more than once.

According to yet another aspect of the invention, a gaming machine for playing a wagering game allows an opportunity to be awarded a progressive fund. The gaming machine includes a wager input device, a display, and a controller. The wager input device receives a wager input from a player of the wagering game. The display is coupled to the wager input device and displays a basic game of the wagering game. The controller is coupled to the display and is programmed to trigger a special event and, during the special event, to provide the player with an opportunity to be awarded the same progressive fund more than once.

According to yet another aspect of the invention, a method for playing a wagering game allows an opportunity to achieve a progressive award. The method includes receiving a wager input from a player for playing the wagering game and triggering a special event including an opportunity of achieving a plurality of progressive game funds. Each of the plurality of progressive game funds is associated with a corresponding reel of a plurality of reels. In response to a first reel in the plurality of reels indicating a first progressive outcome, a first progressive game associated with the first progressive outcome is triggered. The first progressive game includes player-selectable elements that are displayed to the player, each of the player-selectable elements being associated with one of a plurality of outcomes. One of the plurality of outcomes includes a first progressive winning outcome. The method further includes awarding a first progressive fund of the plurality of progressive game fund if the player selects a player-selectable element of the player-selectable elements that is associated with the first progressive fund.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The foregoing and other advantages of the invention will become apparent upon reading the following detailed description and upon reference to the drawings in which:

FIG. 7 shows a number of weighted tables illustrating criteria for triggering a special event, such as a progressive game.

DETAILED DESCRIPTION

Figure 1:
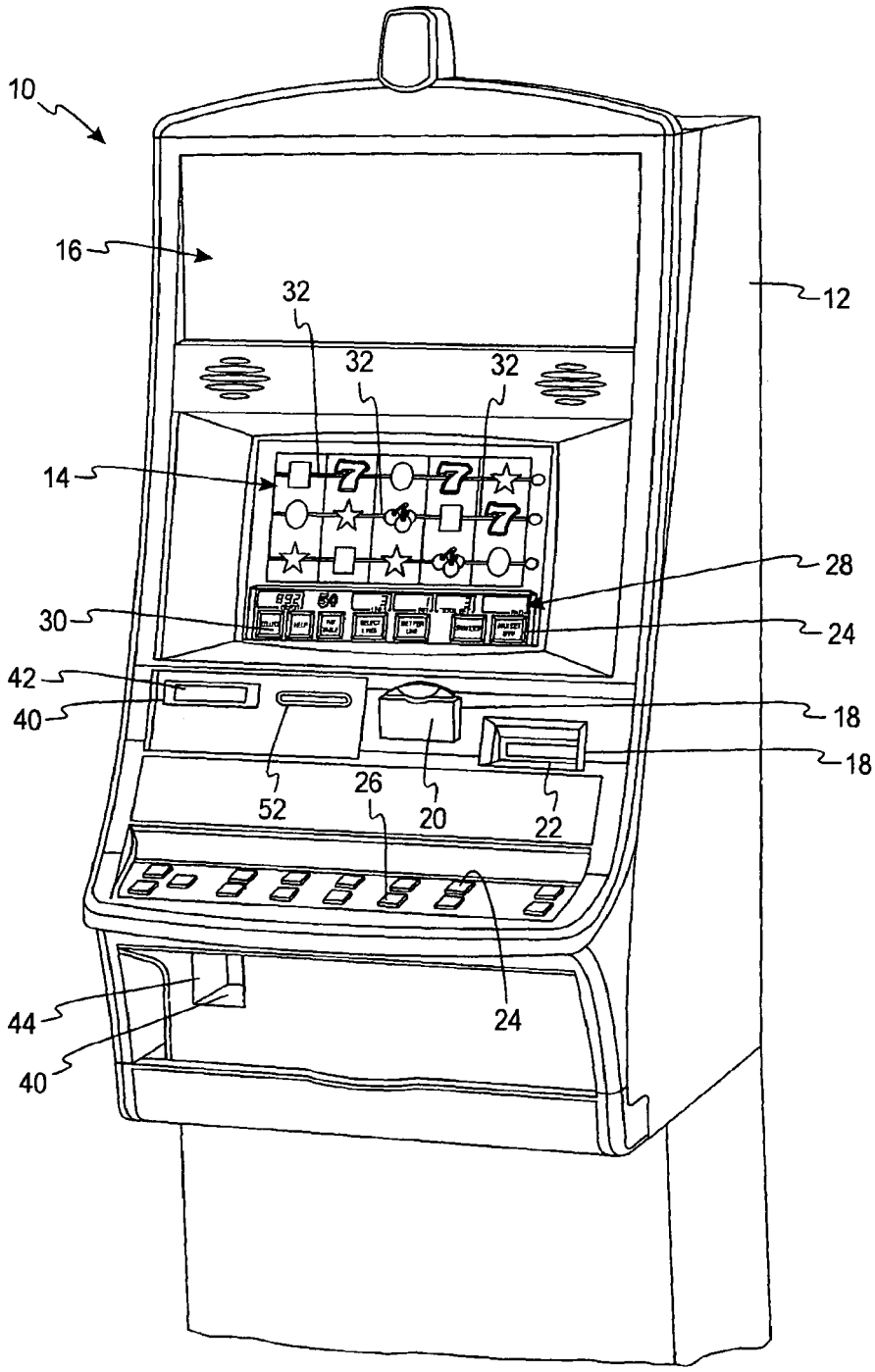
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
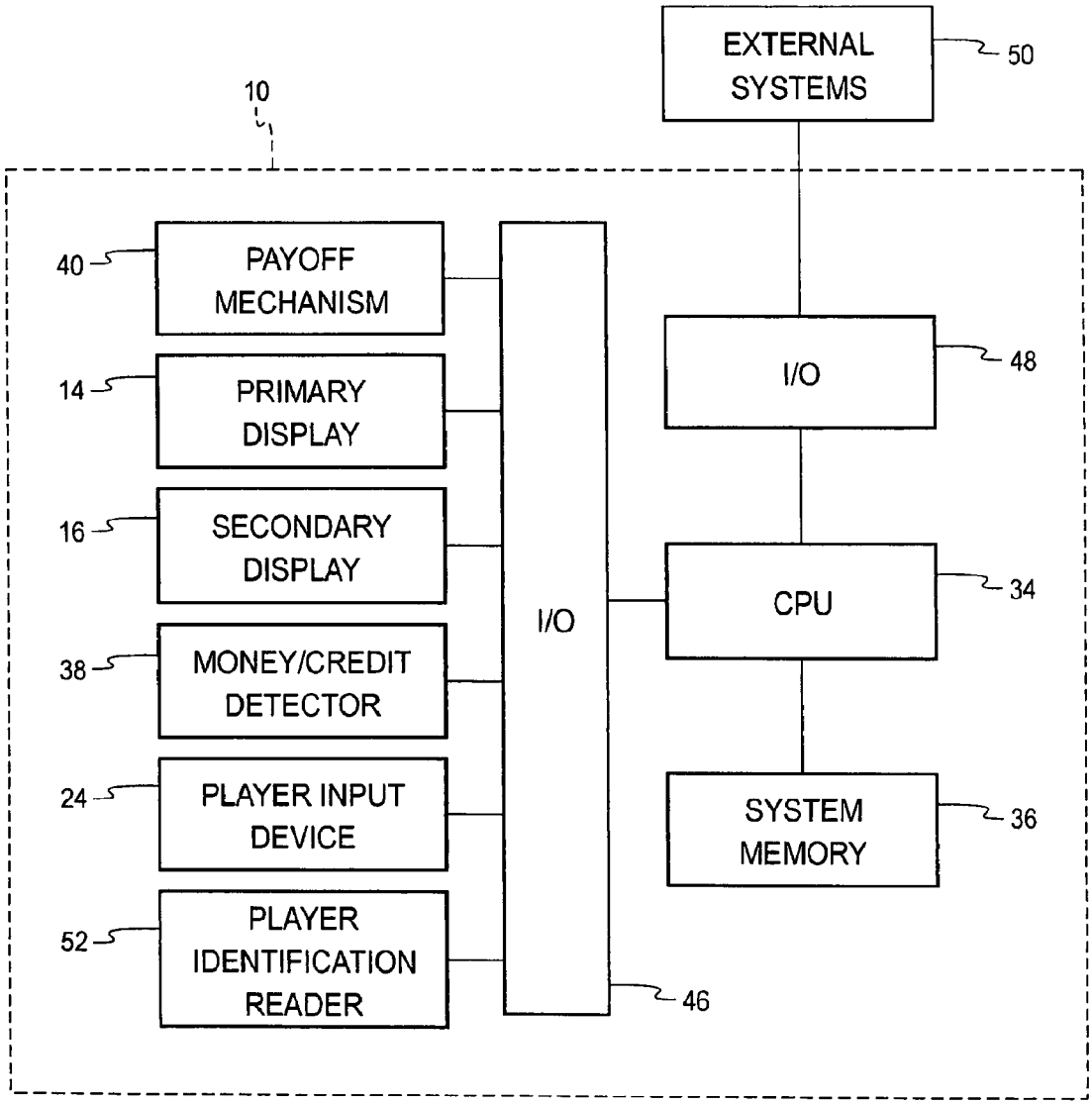
FIG. 2 is a block diagram of a control system suitable for operating the gaming machine of FIG. 1.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Figure 3:
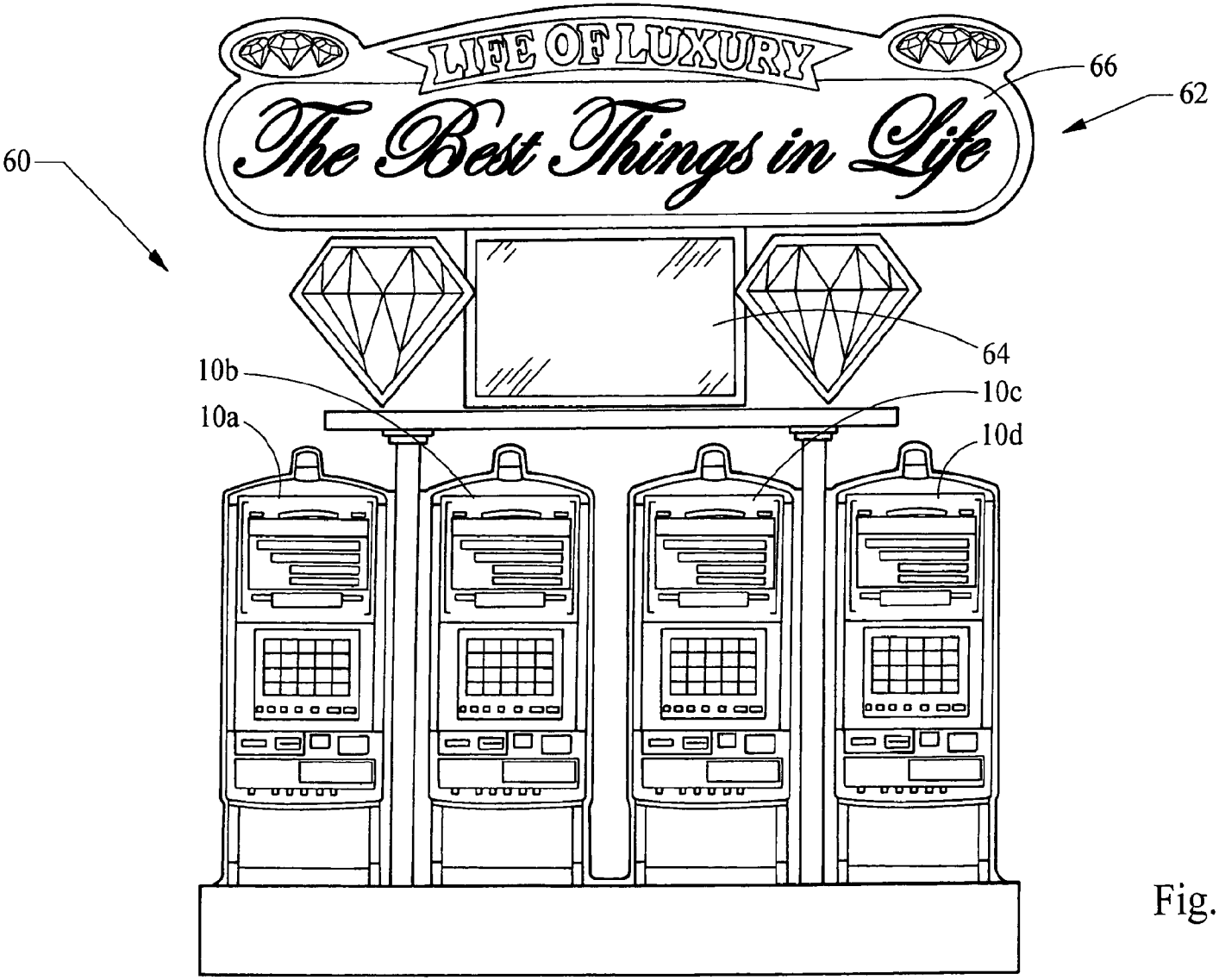
FIG. 3 is a front view of a progressive bank having a plurality of gaming machines.

Referring to FIG. 3, a bank 60 of gaming machines 10*a*-10*d* is shown. The four gaming machines 10*a*-10*d* are of the type described above in relation to FIGS. 1 and 2. The gaming machines 10*a*-10*d* are connected to a bank display 62, which is located generally above the gaming machines 10*a*-10*d*. The bank display 62 includes a large plasma display 64 for displaying an outcome of one of a plurality of triggered special events, such as a progressive game, from the gaming machines 10*a*-10*d*. The special events can include the progressive game and/or other bonus games. The special events can be triggered in response to achieving a certain symbol combination or as a mystery event (e.g., a randomly selected event not known to the player). The plasma display 64 can display any other information such as help messages for the players of gaming machines 10*a*-10*d*, awarded jackpots, etc. The bank display 62 further includes a signage 62 for displaying the name of the game and an associated game theme. For example, the signage 62 shows that the bank 60 is directed to a "Life Of Luxury™" game having the theme "The Best Things In Life."

Figure 4:
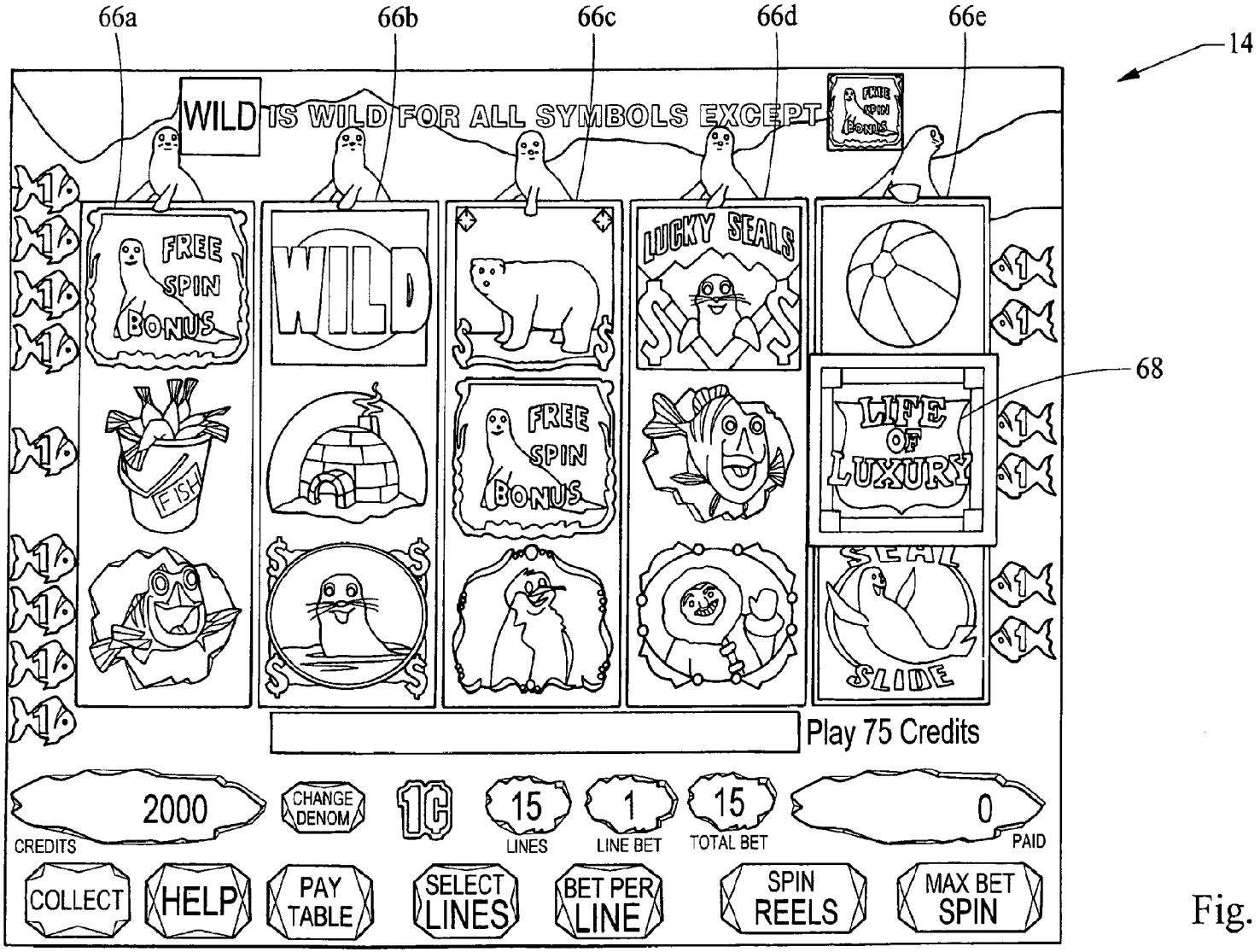
FIG. 4 is a game screen of a basic game that triggers a progressive game.

Referring to FIG. 4, a basic game screen is shown in the primary display 14 of one of the gaming machines 10*a*-10*d*. The basic game screen includes a plurality of spinning reels 66*a*-66*e* having a plurality of symbols for indicating a randomly selected outcome. The randomly selected outcome is selected from a plurality of outcomes that includes a special event triggering outcome. For example, a "Life Of Luxury™" progressive game can be triggered on a particular gaming machine on the bank 60. The triggering of the "Life Of Luxury™" progressive game is indicated by a "Life Of Luxury™" progressive symbol 68 that appears scattered on the last reel 66*e* of the spinning reels 66*a*-66*e*. Alternatively, the "Life Of Luxury™" progressive game can be randomly triggered by a controller such as a bank server independent of any outcome in the basic game (mystery trigger) As explained below, the "Life Of Luxury™" progressive game can be one or more free spins allowing the player to win a progressive award and/or a credit award.

The free spins may be displayed on the primary display 14, on the bank display 62 (e.g., the plasma display 64), or both. For example, to increase excitement among spectators, the games associated with the free spins are displayed on both the primary display 14 and on the bank display 62. Watching on a large plasma display 65 the free spins associated with the "Life Of Luxury™" progressive game is likely to generate interest among spectators and potentially increase the number of players playing on the bank 60 of gaming machines 10*a*-10*d*.

Figure 5:
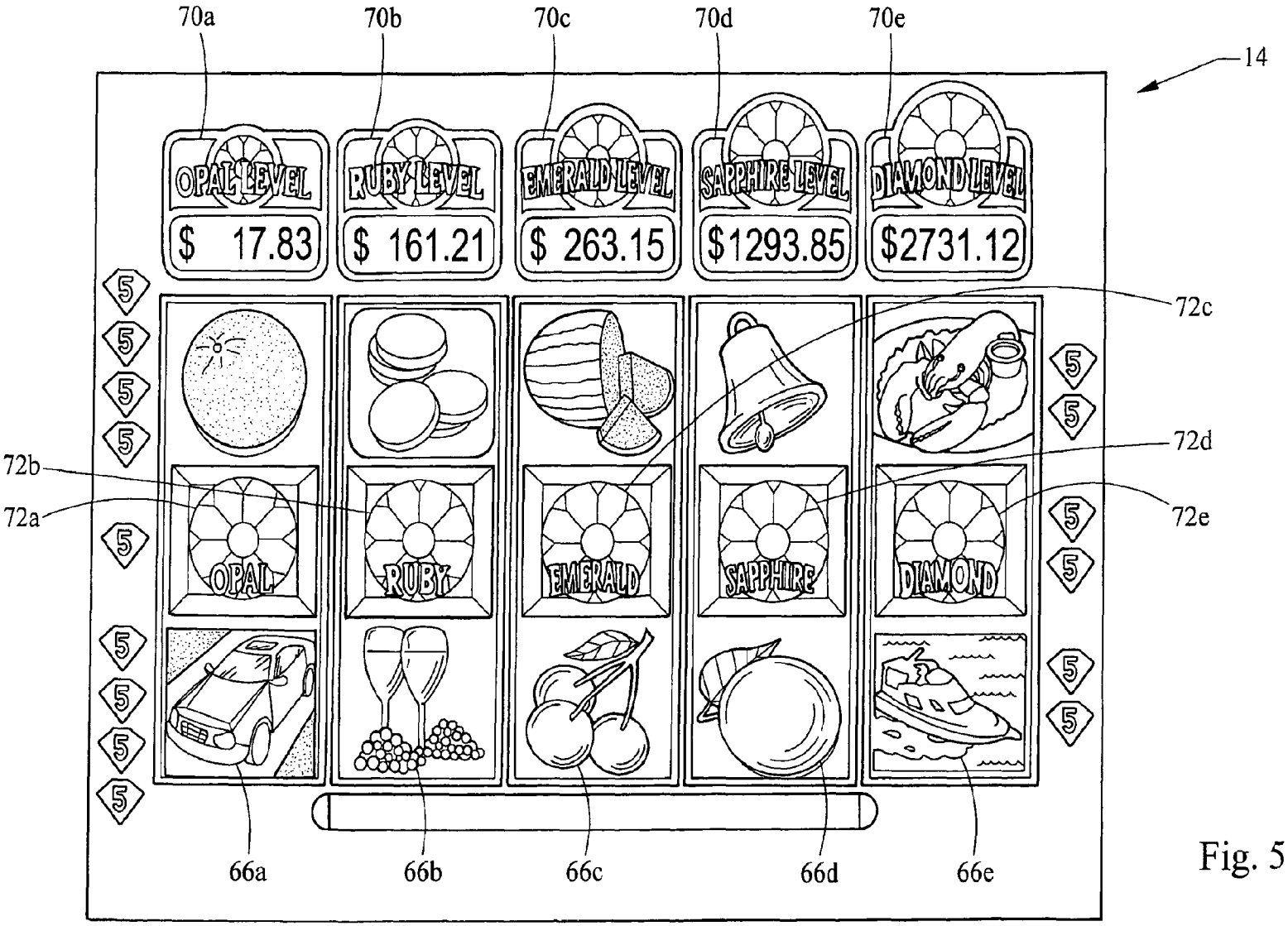
FIG. 5 is a game screen illustrating an opportunity to win five progressive awards.

Referring to FIG. 5, a screen shows the "Life Of Luxury™" free spin game, which includes a plurality of progressive sub-games. Specifically, the free spin game includes an Opal Level progressive sub-game, a Ruby Level progressive sub-game, an Emerald Level progressive sub-game, a Sapphire Level progressive sub-game, and a Diamond Level progressive sub-game. Each sub-game has a corresponding progressive level meter 70*a*-70*e*, respectively, displayed above a corresponding reel 66*a*-66*e*. Each of the progressive level meters 70*a*-70*e* shows an associated award of the sub-game that may be awarded if a particular gem trigger symbol 71*a*-72*e* appears on the corresponding reel. For example, an Opal Level progressive sub-game is triggered if an Opal gem 72*a* appears on the first reel 66*a*. Similarly, a Ruby Level progressive sub-game is triggered if a Ruby gem 72*b* appears on the second reel 66*b*, and so on. Thus, the gem trigger symbol 72*a*-72*e* that is specific to the progressive level meter 70*a*-70*e* triggers the progressive sub-game for that progressive level. When the progressive sub-game is triggered, the player has a chance to win the progressive award associated with the triggered progressive sub-game. For example, if the Opal Level progressive sub-game is triggered, the player has a chance to win an award of $17.83.

Alternatively or in addition, the amount of a progressive jackpot is displayed on a corresponding gem trigger symbol 72*a*-72*e*. For example, the Opal Level progressive jackpot of $17.83 appears on the Opal gem 72*a* when the Opal gem 72*a* appears on the screen. The amount of the progressive jackpot can be displayed as the Opal gem 72*a* is rotating, when the Opal gem 72*a* has stopped, or both. Optionally, the progressive level meters 70*a*-70*e* can be located on the corresponding gem trigger symbol 72*a*-72*e*.

In the typical scenario, a portion of players' wager amounts at the gaming machines 10*a*-10*d* (or from a larger group of gaming machines 10 within one gaming establishment or at several gaming establishments) is used to fund the progressive jackpots. As players continue to play, the progressive jackpots continue to increase based on the received wagering amounts of the players on the bank 60 of gaming machines 10*a*-10*d*. Eventually, the progressive jackpots shown in FIG. 5 may be reset to initial values of progressive jackpots, e.g., the Opal Level progressive jackpot of $17.83 may be rest back to an initial value of $14.00 upon the Opal Level progressive jackpot being awarded.

Figure 6:
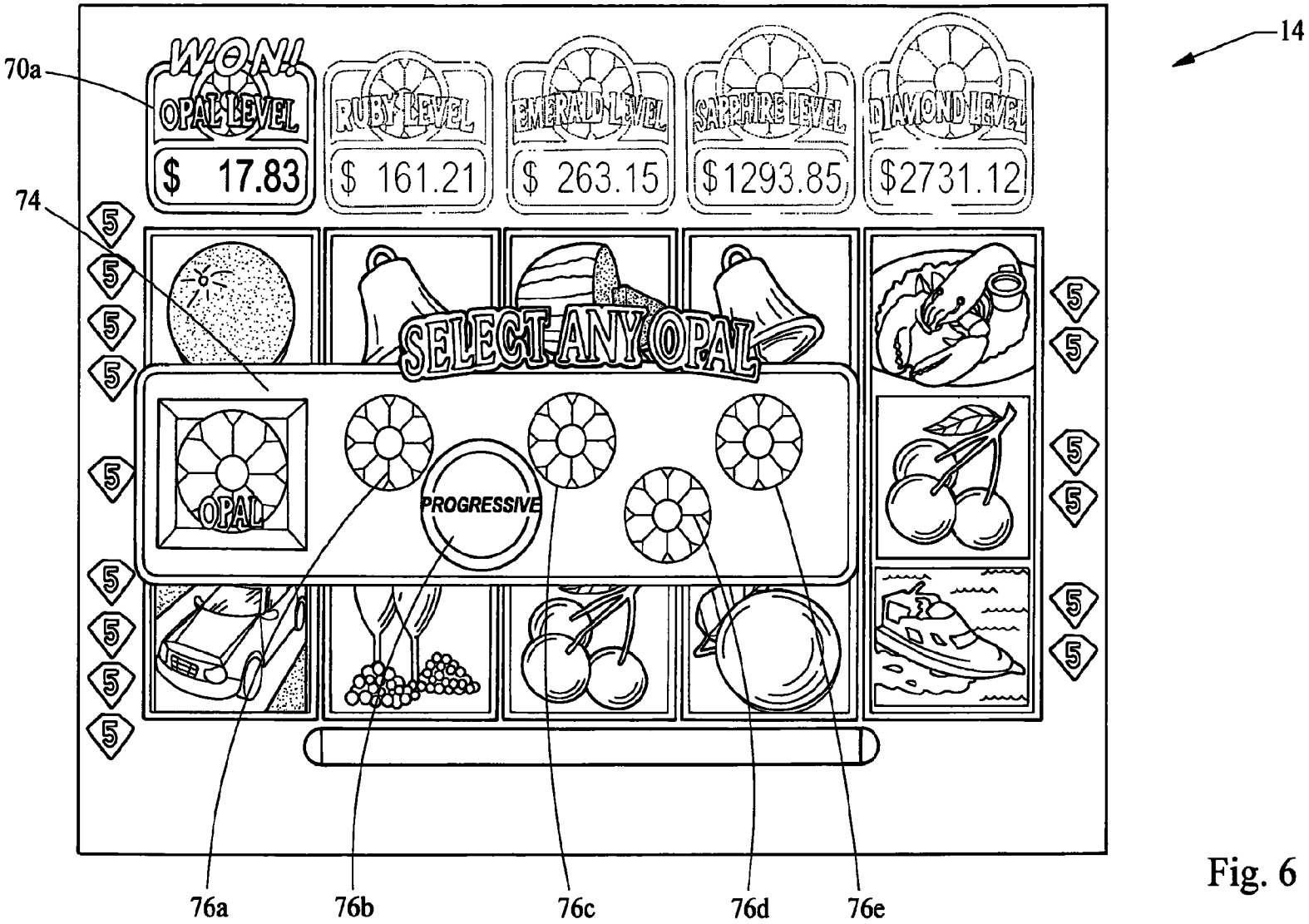
FIG. 6 is a game screen of a progressive game.

Referring to FIG. 6, the Opal Level progressive sub-game has been triggered because the Opal gem 72*a* has appeared on the first reel 66*a* during the free spin gameplay. When the Opal Level progressive sub-game is triggered, a progressive game window 74 is introduced in the bonus screen. The progressive game window 74 is generally overlapping reels 66*a*-66*d* and includes five selectable Opal symbols 76*a*-76*e*. The player selects one (or more) of the selectable Opal symbols 76*a*-76*e* based on the rules of the game. Upon selection, the selected one of the selectable Opal symbols 76*a*-76*e* reveals an award. The revealed award includes a credit value and/or the associated progressive award. The progressive award can be associated with each of the selectable Opal symbols 76*a*-76*e*. The assignment of the progressive award (and other awards amounts) to the symbols 76*a*-76*e* is discussed below with respect to FIG. 7. As shown, the player has selected the second selectable Opal symbol 76*b* and has won the progressive award of the Opal Level progressive (i.e., $17.83).

After the Opal Level progressive sub-game is won, the level is no longer available for the remaining spins and a "Won" indicator reminds the player that he or she has already won the level. If a gem symbol appears on the first reel 66*a* after the Opal Level progressive sub-game has already been won, the selectable Opal symbols 76*a*-76*e* may award only a credit value.

Alternatively, in one preferred embodiment, the base level of the Opal Level progressive jackpot may be won a predetermined number of times during one free spin session. In this case, after the first win of the Opal Level (e.g., $17.83), the player may only win the base level (e.g., $15.00). Or, the Opal Level progressive award can be increasing between the first time the player wins the Opal Level and the second time the player wins it with another free spin due to funding received from portions of wagers.

Further, the player has the possibility to win more than one of the progressive sub-games at one time. For example, referring to FIG. 5, the player can have the option to win each progressive sub-game because a gem trigger symbol 72*a*-72*d* has appeared in each reel 66*a*-66*e*. Accordingly, the player may win all the progressive sub-games during a single spin of the bonus game. When the free bonus spins are exhausted, the free spin game returns back to the basic game.

Referring to FIG. 7, Tables 1-3 show a weighted method for assigning a particular award to each selectable gem, such as gems 76*a*-76*e* in FIG. 6, upon triggering a progressive game. The weighted table includes a total range of "500" randomly selectable (or random) numbers that are separated into six sub-ranges, each of the six sub-ranges being associated with a respective award. After the player triggers the progressive game, the random number generator (RNG) selects five numbers within the total range of "500" for determining outcomes associated with the respective gems 76*a*-76*e*. Specifically, the RNG selects each of the five numbers from the total range of "500" random numbers for association with a respective one of the gems 76*a*-76*e*.

The weighted method is a function of the player's wager input. Specifically, the player's chance of winning a progressive award increases with the player's wager input. The player's wager input is used to modify the lowest range of the weighted table shown in Table 1 to adjust the probability of winning the award associated with the lowest range of random numbers.

In Table 1 the player has wagered the minimum wager of "1" credit. The wager input is used to modify the lowest, or first, sub-range of Table 1. The first sub-range includes a number of random numbers based on the number of wagered credits. Specifically, the first sub-range includes "1" random number that is based on the "1" wagered credit. As an example, if the RNG selects number "1" from the "500" random numbers as the associated number for the second gem 76*b* and the player selects the second gem 76*b*, the player will receive the "Progressive Coin+50 Credits" award (i.e., the progressive jackpot plus fifty credits). Thus, the player has one chance in five hundred to have the progressive jackpot associated with a particular one of the gems 76*a*-76*e*, and—if the progressive jackpot is associated with one of the gems 76*a*-76*e*—one chance in five to select the gem 76*a*-76*e* associated with the progressive jackpot. The second sub-range includes the remaining number of random numbers in the lowest sub-range, i.e., random numbers "2-100," for which the player will receive only "50 Credits."

Referring to Table 2 of FIG. 7, the player has now wagered "60" credits. Based on the "60" wagered credits, the first sub-range now includes "60" random numbers that are associated with the "Progressive Coin+50 Credits" award. Thus, the player's probability of having the progressive jackpot associated with a particular one of the gems 76*a*-76*e* has increased to sixty chances in five hundred. While the player may win the same progressive jackpot ("Progressive Coin+50 Credits") regardless of whether the wager is "1" credit or "60" credits, the chance of winning the progressive jackpot is scaled (e.g., increases linearly) based on the wager.

Referring to Table 3 of FIG. 7, the player has now wagered the maximum wager of "100" credits. In this example, the table now includes only five sub-ranges. Based on the "100" wagered credits, the player has now increased the probability of having the progressive jackpot associated with a particular one of the gems 76*a*-76*e* to one chance in five. Having the lowest sub-range of the weighted table equal to the maximum wager input received from the player assures that the same prize is awarded any time the player receives the progressive triggering symbol (e.g., the Opal gem 72*a*). For example, players A and B wager one credit and one hundred credits, respectively, in a progressive game that has a $100 progressive jackpot. Each player is assured a chance of winning the same $100 progressive jackpot, even though the chance of winning the progressive is higher for player B than for player A.

While the exemplary embodiments described above in reference to Tables 1-3 refer generally to the progressive jackpot being associated with one of the gems 76*a*-76*e*, the progressive jackpot can be associated with more than one gem 76*a*-76*e*. For example, referring to Table 3, the player has wagered "100" credits. Thus, the random numbers associated with the progressive jackpot are numbers "1-100." In this example, it is assumed that the RNG randomly selects five numbers within the range of "1-100" for each of the five numbers associated with the gems 76*a*-76*e*. Thus, because in this example the five selected numbers are all within the range of "1-100," each of the gems 76*a*-76*e* is now associated with the progressive jackpot. In this example, the player is guaranteed the progressive jackpot because regardless of which gem 76*a*-76*e* is selected, the gem 76*a*-76*e* will reveal the progressive jackpot.

Optionally, in the above example, the player may win the progressive jackpot more than once. If the player is permitted to make more than one selection, the player will select at least two gems 76*a*-76*e* that are associated with the progressive jackpot. The player may be awarded a current progressive jackpot for the first selection (e.g., initial award value of $15+a contribution award since previous award of the progressive jackpot) and an initial value of the progressive jackpot (e.g., default award of $15). The contribution award is generally an amount that is funded (or contributed to) by a plurality of players playing on the bank 60 of gaming machines 10*a*-10*d*.

While the present invention has been described with reference to one or more particular embodiments, those skilled in the art will recognize that many changes may be made thereto without departing from the spirit and scope of the present invention.

Each of these embodiments and obvious variations thereof is contemplated as falling within the spirit and scope of the claimed invention, which is set forth in the following claims.

What is claimed is:

1. A method of conducting a wagering game on a gaming system with at least one input device, at least one display device, and at least one processor, the wagering game comprising:

receiving, via the at least one input device, an indication of a wager amount;

displaying, via the at least one display device, a primary game having a plurality of primary reels;

triggering a secondary game during play of the primary game, the secondary game including a plurality of progressive sub-games, each progressive sub-game being associated with at least one progressive award and having a likelihood of triggering that is independent from the wager amount;

triggering a first progressive sub-game during play of the secondary game;

providing an opportunity for a first progressive-winning outcome during play of the first progressive sub-game, the first progressive-winning outcome awarding a first progressive award associated with the first progressive sub-game, the opportunity having an associated first probability of achieving the first progressive-winning outcome, the first probability being dependent on the wager amount; and awarding the first progressive award in response to achieving the first progressive-winning outcome.

2. The method of claim 1, wherein receiving a maximum wager amount guarantees that the first progressive-winning outcome will be achieved if the first progressive sub-game is triggered during the secondary game.

3. The method of claim 1, wherein receiving a minimum wager amount guarantees that the first probability is greater than zero that the first progressive-winning outcome will be achieved if the first progressive sub-game is triggered during the secondary game.

4. The method of claim 1, wherein the first probability of achieving the first progressive-winning outcome after the first progressive sub-game has been triggered is proportional to the wager amount.

5. The method of claim 1, wherein the first progressive sub-game and a second progressive sub-game of the plurality of progressive sub-games have a different likelihood of triggering, the first and second progressive sub-games likelihoods of triggering being independent of the wager amount.

6. The method of claim 1, further comprising:

triggering a second progressive sub-game during play of the secondary game;

providing an opportunity for a second progressive-winning outcome during play of the second progressive sub-game, the second progressive-winning outcome awarding a second progressive award associated with the second progressive sub-game, the opportunity having an associated second probability of achieving the second progressive-winning outcome, the second probability being dependent on the wager amount, the second probability being the same as the first probability.

7. The method of claim 1, wherein the first progressive award can only be awarded by achieving the first progressive-winning outcome during play of the first progressive sub-game.

8. The method of claim 1, further comprising displaying, via the at least one processor and after the secondary game has been triggered during play of the primary game, the secondary game having a plurality of secondary reels and at least one special symbol, each of the plurality of secondary reels being associated with at least one of the plurality of progressive sub-games, each of the progressive sub-games being triggered when the at least one special symbol appears on the secondary reel associated with the respective progressive sub-games.

9. The method of claim 1, wherein the secondary game is one or more special symbol appearing during play of the primary game.

10. The method of claim 9, wherein the primary reels are arranged from left to right on the at least one display and the special symbol is only located on the rightmost primary reel.

11. A gaming system for playing a wagering game, the gaming system comprising:

at least one input device;

at least one display device;

at least one processor; and at least one memory device storing instructions which cause the at least one processor to operate with the at least one display device and the at least one input device to:

receive an indication of a wager amount;

display a primary game having a plurality of primary reels;

trigger a secondary game during play of the primary game, the secondary game including a plurality of progressive sub-games, each progressive sub-game being associated with at least one progressive award and having a likelihood of triggering that is independent from the wager amount;

trigger a first progressive sub-game during play of the secondary game;

provide an opportunity for a first progressive-winning outcome during play of the first progressive sub-game, the first progressive-winning outcome awarding a first progressive award associated with the first progressive sub-game, the opportunity having an associated first probability of achieving the first progressive-winning outcome, the first probability being dependent on the wager amount; and award the first progressive award in response to achieving the first progressive-winning outcome.

12. The gaming system of claim 11, wherein receiving a maximum wager amount guarantees that the first progressive-winning outcome will be achieved if the first progressive sub-game is triggered during the secondary game.

13. The gaming system of claim 11, wherein the first probability of achieving the first progressive-winning outcome after the first progressive sub-game has been triggered is proportional to the wager amount.

14. The gaming system of claim 11, wherein the first progressive sub-game and a second progressive sub-game of the plurality of progressive sub-games have a different likelihood of triggering, the first and second progressive sub-games likelihoods of triggering being independent of the wager amount.

15. The gaming system of claim 11, wherein the at least one memory device further stores instructions which cause the at least one processor to operate with the at least one display device and the at least one input device to:

trigger a second progressive sub-game during play of the secondary game;

provide an opportunity for a second progressive-winning outcome during play of the second progressive sub-game, the second progressive-winning outcome awarding a second progressive award associated with the second progressive sub-game, the opportunity having an associated second probability of achieving the second progressive-winning outcome, the second probability being dependent on the wager amount, the second probability being the same as the first probability.

16. A computer program product comprising one or more non-transient computer-readable media including instructions which, when executed by one or more processors, cause the one or more processors to operate with one or more input devices and one or more display devices to:

receive, via the one or more input devices, an indication of a wager amount;

display, via the one or more display devices, a primary game having a plurality of primary reels;

trigger a secondary game during play of the primary game, the secondary game including a plurality of progressive sub-games, each progressive sub-game being associated with at least one progressive award and having a likelihood of triggering that is independent from the wager amount;

trigger a first progressive sub-game during play of the secondary game;

provide an opportunity for a first progressive-winning outcome during play of the first progressive sub-game, the first progressive-winning outcome awarding a first progressive award associated with the first progressive sub-game, the opportunity having an associated first probability of achieving the first progressive-winning outcome, the first probability being dependent on the wager amount; and award the first progressive award in response to achieving the first progressive-winning outcome.

17. The computer program product of claim 16, wherein receiving a maximum wager amount guarantees that the first progressive-winning outcome will be achieved if the first progressive sub-game is triggered during the secondary game.

18. The computer program product of claim 16, wherein the first probability of achieving the first progressive-winning outcome after the first progressive sub-game has been triggered is proportional to the wager amount.

19. The computer program product of claim 16, wherein the first progressive sub-game and a second progressive sub-game of the plurality of progressive sub-games have a different likelihood of triggering, the first and second progressive sub-games likelihoods of triggering being independent of the wager amount.

20. The computer program product of claim 16, further including instructions which, when executed by one or more processors, cause the one or more processors to operate with the one or more input devices and the one or more display devices to:

trigger a second progressive sub-game during play of the secondary game;

provide an opportunity for a second progressive-winning outcome during play of the second progressive sub-game, the second progressive-winning outcome awarding a second progressive award associated with the second progressive sub-game, the opportunity having an associated second probability of achieving the second progressive-winning outcome, the second probability being dependent on the wager amount, the second probability being the same as the first probability.

* * * * *